United States Patent [19]

Goetz et al.

[11] Patent Number: 5,034,070

[45] Date of Patent: Jul. 23, 1991

[54] GAS GENERATING MATERIAL

[75] Inventors: George W. Goetz, Rochester Hills; Thomas H. Vos, Rochester, both of Mich.

[73] Assignee: TRW Vehicle Safety Systems Inc., Lyndhurst, Ohio

[21] Appl. No.: 547,623

[22] Filed: Jun. 28, 1990

[51] Int. Cl.[5] ..... C06B 45/18

[52] U.S. Cl. ..... 149/3; 149/5; 149/22; 149/35; 149/40; 149/41; 149/43; 149/109.6; 149/110; 264/3.4

[58] Field of Search ..... 149/3, 5, 22, 35, 40, 149/41, 43, 109.6, 110; 264/3.4

[56] References Cited

U.S. PATENT DOCUMENTS

| | | | |
|---|---|---|---|
| 3,883,373 | 5/1975 | Sidebottom | 149/6 |
| 4,244,758 | 1/1981 | Garner et al. | 149/7 |
| 4,246,051 | 1/1981 | Garner et al. | 149/7 |
| 4,339,288 | 7/1982 | Camp | 149/8 |
| 4,390,380 | 6/1983 | Camp | 149/8 |
| 4,696,705 | 9/1987 | Hamilton | 149/21 |
| 4,698,107 | 10/1987 | Goetz et al. | 149/7 |
| 4,806,180 | 2/1989 | Goetz et al. | 149/5 |

*Primary Examiner*—Steven J. Lechert, Jr.
*Attorney, Agent, or Firm*—Tarolli, Sundheim & Covell

[57] ABSTRACT

A gas generating grain has a water-based particulate booster coating thereon. The coating comprises an alkali metal azide, a water-soluble inorganic oxidizer in approximately a stoichiometric proportion of oxidizer to azide, and a nucleating amount of a small particle size metal oxide, preferably selected from the group consisting of iron oxide, nickel oxide and aluminum oxide. The coating is applied to said grain from a water slurry and dried, and when dried has an average particle size of less than about 50 microns.

36 Claims, 1 Drawing Sheet

GAS GENERATING MATERIAL

BACKGROUND OF THE INVENTION

1. Technical Field

The present invention relates to gas generating material for a vehicle occupant restraint such as an airbag, and to a method for making the gas generating material. The present invention relates particularly to a booster coating for gas generating grains.

2. Description of the Prior Art

A known gas generating grain for a vehicle occupant restraint comprises an azide, such as sodium azide and a metal oxidant, such as iron oxide. The composition may also contain a forming aid, such as bentonite, strengthening fibers such as graphite fibers, and an inorganic source of oxygen, such as sodium nitrate. The ingredients of the composition are proportioned to obtain a desired burn rate, rapid ignition, and stability against inadvertent ignition.

It is also known to provide a gas generating grain with a booster coating which enhances ignition U.S. Pat. No. 4,806,180, assigned to the assignee of the present application, discloses a booster coating comprising 30–50 percent by weight of a metal azide, 40–60 percent by weight of an inorganic oxidizer, 5–15 percent by weight of boron, and 1-15 percent by weight of an alkali metal silicate. Sodium nitrate is disclosed as one suitable inorganic oxidizer. The boron produces heat to assist in igniting the grain to which the coating is applied. A preferred method of coating the grains involves first preparing a liquid coating mix in an appropriate container with a suitable solvent such as acetone or methyl alcohol. Water can also be used as the solvent. The grains are then placed in a steel mesh basket. The grains in the basket are immersed in the coating mix and then removed from the coating mix and dried.

A coating composition has been proposed which is applied to the grain as a paste. The coating includes sodium nitrate and sodium azide. The sodium nitrate is first pulverized in a micro-pulverizer and then blended with sodium azide and a binder. Both the sodium azide and the sodium nitrate before blending are screened through a 100 mesh screen. Alcohol is added to form a paste. The gas generating grains are coated with the alcohol paste. The use of alcohol, instead of water, as a solvent minimizes dissolution of the grain which is coated. A small amount of water is introduced as steam into the coating vessel. About 10 milliliters of water per fifty pounds of coating material is introduced into the coating vessel. This provides improved bonding of the coating to the grains. Following coating, the grains are placed in a 90° C. (194° F.) oven for overnight drying.

U.S. Pat. Nos. 4,696,705 and 4,698,107, assigned to assignee of the present application, disclose a coating composition for a nitrogen gas generating grain for a vehicle occupant restraint. The coating composition contains 10–15 percent by weight of a fluoroelastomer binder. The composition also contains 20–50 percent by weight of alkali metal azide, 25–35 percent by weight of inorganic oxidizer, 15–25 percent by weight of magnesium, and 1–3 percent by weight of fumed metal oxide. The ingredients are mixed with a suitable solvent and applied to the grain. The fumed metal oxide functions in the coating mix as a suspension agent and keeps the ingredients of the coating composition suspended in the mix so that a uniform coating is applied to the grain.

Coating compositions which are dissolved in an organic solvent for application to a gas generating grain are disclosed in U.S. Pat. Nos. 4,244,758 and 4,246,051.

A problem with an organic solvent-based coating, such as an acetone-based coating, is that vapors from the solvent of the coating create a fire hazard and/or may be toxic.

SUMMARY OF THE INVENTION

The present invention resides in a gas generating grain which has a booster coating thereon. The booster coating comprises a water-soluble inorganic oxidizer, such as sodium nitrate, and an alkali metal azide. The inorganic oxidizer is present in approximately a stoichiometric proportion of oxidizer to azide. The coating also contains a small amount of a small particle size water-insoluble metal oxide. A preferred metal oxide is selected from the group consisting of iron oxide, nickel oxide and aluminum oxide. The coating is applied to the gas generating grain as a water slurry and is rapidly dried. The coating is in the form of a plurality of particulates adhered to the grain and preferably has an average particle size less than about fifty microns.

The coating preferably contains a metallic fuel selected from the group consisting of boron, titanium, zirconium and silicon. A preferred coating following drying comprises about 34–37 weight percent inorganic oxidizer, about 54–58 weight percent alkali metal azide, about 3–6 weight percent boron, and about 1–3 weight percent iron oxide. Preferably, the iron oxide has an average particle size less than about 0.5 microns.

BRIEF DESCRIPTION OF THE DRAWINGS

The foregoing and other features of the present invention will become more apparent to one skilled in the art upon consideration of the following description, with reference to the accompanying drawings, in which.

DESCRIPTION OF A PREFERRED EMBODIMENT OF THE INVENTION

A body 10 (known as a "grain") of gas generating material is used in inflatable vehicle occupant restraint systems to inflate an occupant restraint, such as an airbag. The grain 10, or a plurality of grains 10, of gas generating material could be used in man different types of inflatable restraint systems. One inflatable restraint system in which the grains of gas generating material may be used is described in U.S. Pat. No. 4,817,828, assigned to the assignee of the present application, issued Apr. 4, 1989 and entitled "Inflatable Restraint System".

The grain 10 of gas generating material includes a fuel which is a source of nitrogen gas and an oxidizer which reacts with the fuel. The grain 10 of gas generating material also contains an oxidizing agent, extruding aid and strengthening fibers. The preferred fuel or source of nitrogen gas is an alkali metal azide, such as sodium, potassium or lithium azide. Sodium azide is the most preferred alkali metal azide. The oxidizer is preferably a metal oxide. The metal of the metal oxide may be any metal lower in the electromotive series than the alkali metal. Examples of preferred metals are iron, copper, manganese, tin, titanium, or nickel, and combinations thereof. The most preferred oxidizer is iron oxide.

The oxidizing agent in the grain 10 may be an alkali metal nitrate, chlorate, and/or perchlorate or combinations of the foregoing. At the present time, it is preferred to use sodium nitrate as the oxidizing agent. Relatively small amounts of an extrusion aid and strengthening fibers are provided in the grain 10 of gas generating material. Bentonite is the preferred extrusion aid. Graphite fibers are preferably used as the strengthening fibers.

The grain 10 of gas generating material has the following proportions of ingredients by weight:

TABLE 1

| Ingredient | Amount | Range |
|---|---|---|
| Sodium azide ($NaN_3$) | 57.9% | ±10% |
| Iron oxide ($Fe_2O_3$) | 34.6% | ±10% |
| Graphite | 3% | 0 to 6% |
| Bentonite | 2.5% | 0 to 5% |
| Sodium Nitrate ($NaNO_3$) | 2% | 0 to 10% |

It should be understood that the composition of the grain 10 of gas generating material could be different than the specific composition set forth above. For example, an alkali metal azide other than sodium azide could be used. Also, a different oxidizer could be used. Although graphite fibers are preferred to provide mechanical reinforcement, other fibers could be used, such as glass fibers and iron fibers Extrusion aids other than bentonite could be used, and/or oxidizing agents other than sodium nitrate could be used, such as ammonium perchlorate. If desired, the composition of the grain of gas generating material could be the same as described in U.S. Pat. No. 4,806,180, assigned to the assignee of the present application, issued Feb. 21, 1989 for "Gas Generating Material".

Figure 2:
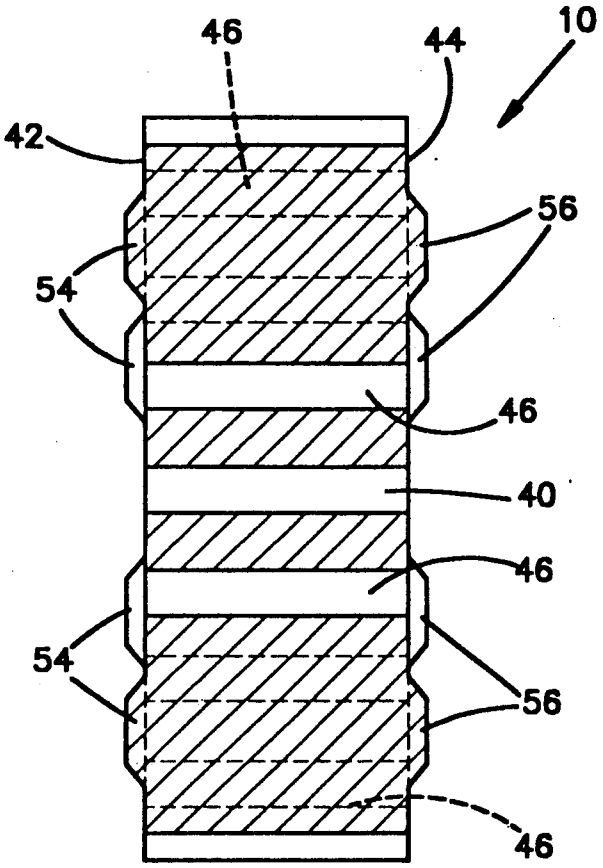
FIG. 2 is a sectional view, taken along the line 2–2 of FIG. 1, further illustrating the construction of the body of gas generating material.

The grain 10 (FIGS. 1 and 2) has a generally cylindrical shape and has a cylindrical central passage 40 with an axis disposed on the central axis of the grain. The passage 40 extends between axially opposite end faces 42, 44 (FIG. 2) of the grain. In addition, the grain 10 has a plurality of cylindrical passages 46 which are disposed radially outwardly relative to central passage 40 and which also extend longitudinally through the grain between the opposite end faces 42, 44.

Figure 1:
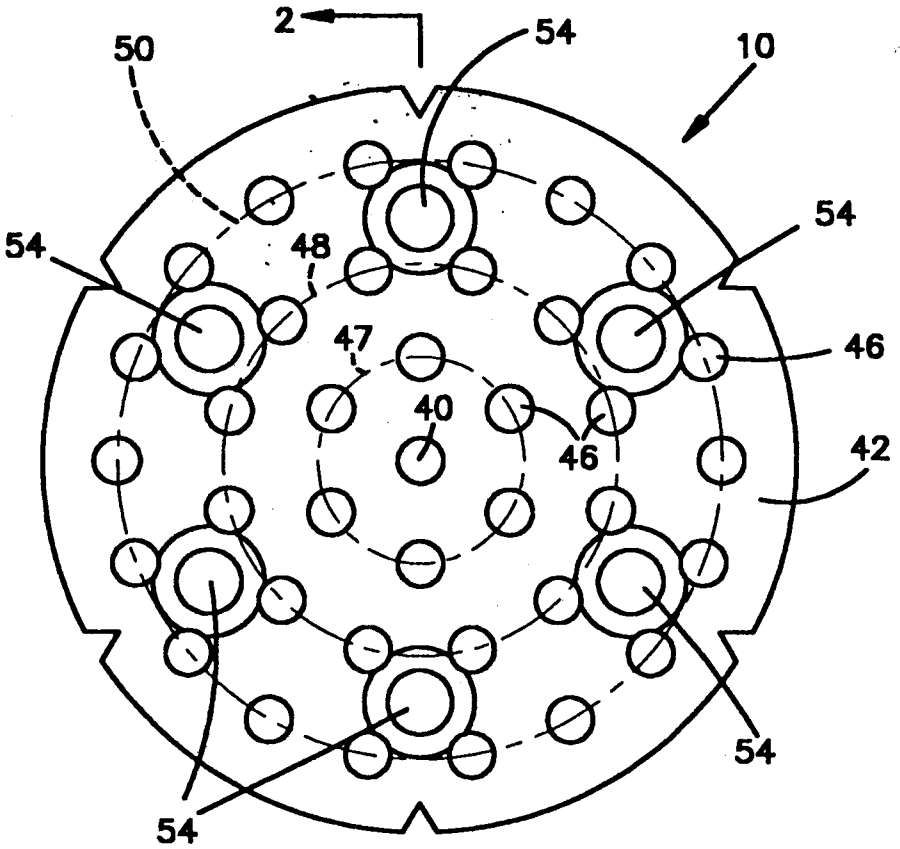
FIG. 1 is a plan view of a body of gas generating material used in a vehicle occupant restraint system.

The axes of the passages 46 are parallel to the axis of passage 40. The passages 46 are evenly spaced, on concentric circles 47, 48 and 50 which are radially spaced from passage 40, but co-axial with the axis of passage 40. As shown in FIG. 1, the axes of the passages 46 on one of the concentric circles are offset circumferentially, to one side, from the axes of the passages 46 on the other concentric circles. In this respect, a passage 46 on a first concentric circle is spaced from an offset passage on an adjacent concentric circle the same distance that it is spaced from an adjacent passage 46 on the first concentric circle.

When used to inflate an airbag, the plurality of grains 10 are stacked so that the passages in one grain are aligned with the passages in all of the other grains. Thus, hot gas generated by burning one grain flows through the passages to ignite adjacent grains, and the surfaces of the passages of all of the bodies are quickly ignited.

The gas which is generated within the passages must be able to get out of the passages and flow radially of the grains into an airbag to inflate the airbag. To provide for such flow, spaces are provided between the end faces 42, 44 (FIG. 2) of adjacent grains 10. The spaces extend radially outward from the central passage 40 of the bodies. The spaces between the ends of adjacent grains are provided by axially projecting standoff pads 54, 56 (FIG. 2) on the end faces 42, 44. As disclosed in prior U.S Pat. No. 4,817,828, the standoff pads of one grain are aligned with those of an adjacent grain so that the spaces between the grains are provided by the combined height of the standoff pads of adjacent bodies. Several standoff pads 42, 44 are positioned in circumferentially spaced apart relationship on each end face so as to maintain the end faces of adjacent grains in spaced apart parallel planes.

The plurality of passages 40, 46 in a grain 10 promote what has been referred to as a progressive rate of burn of a grain. A progressive rate of burn is one in which the burning proceeds, for a substantial part of the burn cycle, at a rate which increases. As the circumferential surfaces of the passages burn, the passages widen, exposing increasingly more surface area to burning. Simultaneously, the outer circumference of each grain 10 shrinks, reducing the surface area exposed to burning, but this reduction in surface area is less than the increase in surface area produced by burning in the passages in the grain. At a point in the burn cycle, the burn rate ceases to increase and remains constant until near the end of the burn cycle, at which time the rate of burn will decrease to zero.

The process for manufacturing the gas generating material is disclosed in co-pending application Ser. No. 528144, filed 5/24/90, assigned to the assignee of the present application. The gas generating material is formed by preparing a wet mixture of the metal azide and metal oxide. The wet mixture of the metal azide and metal oxide is prepared without prior mixing of the metal azide and metal oxide in dry form. By having the metal azide and metal oxide contact each other only when they are wet, the possibility of fire and/or explosion is minimized during the manufacturing process. During processing of the wet mixture of gas generating material, the mixture is repeatedly ground to reduce the particle size of one or more ingredients of the mixture. During the grinding of the wet mixture, the mixture is also cooled to maintain the temperature of the mixture in a desired temperature range of 20° C. to 30° C. Once the wet mixture of gas generating material has been formed, excess liquid is removed from the mixture, for instance, by centrifuging. Following partial drying, the wet mixture (cake) of gas generating material is extruded to form small cylindrical granules or pellets of the gas generating material. The cylindrical granules are preferably formed into spherical granules in a spheronizing process and then subjected to drying. The granules may then be stored for later use. The granules are removed from storage and pressed together to form the grains 10 of gas generating material shown in FIGS. 1 and 2. Once the grains 10 of gas generating material have been formed by the pressing step, the grains of gas generating material are coated with an ignition enhancing booster material, and then are transferred to a continuous drier where they are dried. The dried grains 10 of gas generating material are then packaged for use in a vehicle occupant restraint system.

A common practice in the prior art has been to use an organic solvent, such as an alcohol, for forming a grains coating slurry. This has been the case even if the ingredients of the coating are water-soluble. The reason for this is that the grains have been, at least to some degree, water soluble. The grains have been less soluble in an organic solvent, and thus less subject to dissolution during the coating step.

The grains 10 (FIGS. 1 and 2) are less subject to dissolution by water than grain structures of the prior art. This permits the use of a water-based coating slurry, in the coating step, rather than an organic solvent-based slurry. Since the coating is water-based, the formation of hazardous, e.g. explosive and/or toxic organic fumes, is avoided.

The coating slurry of the present invention, which is applied to the surface of a grain, comprises water, an alkali metal azide, such as sodium azide or potassium azide, and a water soluble inorganic oxidizer which is reactive with the azide. The coating slurry also contains a small particle size water-insoluble metal oxide, preferably selected from the group consisting of iron oxide, nickel oxide, and aluminum oxide. The coating slurry preferably also contains a small amount of a metallic fuel such as boron.

The coating ingredients are added to the water to form a water slurry, in the weight ratio of about 50/50 to 70/30 solids to water. The amount of water is sufficient to completely dissolve the water soluble inorganic oxidizer. The alkali metal azide is only partially water soluble and is only partially dissolved. The metal oxide and metallic fuel are insoluble in water.

The slurry is continuously subjected to particle size reduction, for instance, in a colloid mill, primarily to keep the particle size of the undissolved alkali metal azide relatively small. Preferably, the undissolved alkali metal azide is maintained at a particle size less than about a twenty micron average particle size. Other non-soluble ingredients of the composition, e.g. the metal fuel and the metal oxide, are commonly available in very small particle sizes.

The grains are then coated with the coating slurry in any conventional coating process. One method is to place the grains in a coating basket and immerse the grains into the coating slurry. After removal from the coating slurry, excess coating is blown from the grains until the grains are tacky-dry. The grains are then placed in an oven and completely dried. The grains are rapidly dried. During drying, the coating forms on the grains as small particulates. The depth of the coating may be about one-two tenths of a millimeter. The particulates of the coating have a small size, for instance, less than about 50 microns (about 0.5 mm).

During drying, it is possible for some separation of the ingredients to occur, e.g. settling of the boron in the coating layer. By rapidly drying the coating, separation is minimized, and a more uniform coating is obtained. Preferably, at least the initial drying is carried out in an oven at a high temperature, for instance above about 260° F., e.g. about 300°–350° F. Preferably, the drying is accompanied by rapid air circulation. At a high temperature, with air circulation, the grains are essentially free from agglomeration in about one minute, and essentially dry in about ten minutes.

The inorganic oxidizer is highly water soluble. A preferred inorganic oxidizer is a nitrate, more preferably an alkali metal nitrate such as sodium nitrate or potassium nitrate. The alkali metal nitrates are sufficiently reactive with the alkali metal azides so that the combination ignites readily. An alkali metal azide in an acidic solution reacts to produce hydrazoic acid ($HN_3$). Hydrazoic acid vapors are toxic. The alkali metal nitrate, in addition to being a reactant, functions to buffer the water slurry containing the alkali metal azide, minimizing the generation of hydrazoic acid. The proportion of inorganic oxidizer, e.g. sodium nitrate to alkali metal azide, e.g. sodium azide, in the coating slurry, is slightly in excess of a stoichiometric proportion, e.g., 107% of the amount required to react stoichiometrically with the azide. It has been discovered that when a water-based coating slurry is applied to a grain substrate, which contains water soluble ingredients, there is a level of exchange of material between the coating slurry and the grain. For instance, it has been ascertained that when a 60/40 solids/water coating slurry, containing sodium nitrate is applied to a grain, there is a reduction in the percentage of sodium nitrate in the coating composition to the extent that the coating after drying is under-oxidized or has too little oxidizer and ignition is poor. To obtain the proper stoichiometry in the coating, the coating slurry, prior to immersion of a grain in the slurry, should have about 7% extra oxidizer or about 107% of the stoichiometric proportion of oxidizer, for effective ignition. During the coating process and prior to complete drying, the exchange of material between the coating slurry and the grain results in about a 7% depletion of the oxidizer in the coating composition. Thus, when completely dried, the coating has approximately a stoichiometric proportion of oxidizer to azide. Other suitable water-based inorganic oxidizers are perchlorates, such as potassium perchlorate. A preferred weight ratio of oxidizer to azide, in the slurry, when the oxidizer is a nitrate, is in a range of about 0.6:1 to about 0.7:1.

The water-insoluble metal oxide is an important ingredient of the present invention. A preferred metal oxide is iron oxide. Other oxides such as nickel oxide and aluminum oxide can also be used. The metal oxide should have a very small particle size, preferably less than about 0.5 micron average particle size, e.g., about 0.2 micron average particle size. Only a small amount of metal oxide is required. The metal oxide functions in the coating composition of the present invention as a nucleating agent to promote the growth of small crystals and inhibit the growth of large crystals in the drying step, which follows application of the coating slurry to the gas generating grains. Thus, a preferred amount of metal oxide is a nucleating amount. Preferably, the amount of metal oxide is about 1%–3% based on the weight of the coating, absent water. Small crystals in the coating adhere better to the gas generating grains. Smaller crystals also burn more rapidly, reducing ignition time of the gas generating composition. Preferably, as mentioned above, the coating has an average particulate size following drying of less than about 50 microns, preferably less than about 20 microns. The metal oxide is also a reactant with the azide, on ignition of the coating composition.

The coating slurry of the present invention also preferably contains a metal fuel. A preferred metal fuel is boron. Examples of other metal fuels which can be used are titanium, zirconium and silicon. The metal fuel also preferably has a small particle size. An example of a small particle size fuel is a commercial pyrotechnic grade boron having an average particle size of about one micron. The metal fuel functions in the coating of the present invention to raise the flame temperature of the coating. Only a small amount of metal fuel is desirable, e.g. zero to about 10%, preferably about 3–6%, based on the total coating weight.

A preferred coating slurry comprises (minus water):

TABLE 2

| Ingredient | Weight Percentage |
|---|---|
| Sodium Nitrate | 36.59 ± 1.0% |
| Sodium Azide | 56.82 ± 1.5% |
| Boron | 4.51 ± 0.1% |
| Iron Oxide | 2.08 ± 0.1% |

The coating slurry, comprising dissolved and suspended ingredients in water, is applied to the grains by immersion of the grains in the slurry mix. The viscosity of the coating composition, the time of immersion and the velocity of the air curtain directed at the grains to remove excess coating slurry, are adjusted so as to leave about 5.5±0.5% of the weight of the grain before coating as the solids coating weight on the grain.

The following Example illustrates the practice of the present invention.

EXAMPLE

In this Example, a 60/40 ratio, by weight of solids/-water slurry was prepared using the composition of Table 2. Sodium nitrate was dissolved to the point of saturation under constant stirring in water. The boron and iron oxide were then added. The azide was blended into the nitrate solution under a fume hood. The slurry was black in color and the consistency of heavy cream. The slurry was continuously recirculated through a colloid mill to maintain the particle size of the sodium azide at about twenty microns average particle size. An air hose was positioned such that it provided a gentle flow of air down towards the vessel of coating slurry. The gas generating grains were dipped into the coating slurry for about three seconds. The gas generating grains had a composition similar to that of Table 1. The coated grains were then passed under the curtain of air, to remove excess coating slurry. After a few seconds under the curtain of air, the grains were placed in a tray for batch drying. Drying was carried out rapidly in an oven at about 260° F. with high speed air circulation. The grains were essentially free from agglomeration in about one minute, and essentially dry in about ten minutes. The coating had a uniform composition throughout. The coating particulates on the grain had an average particle size of about 50 microns. About 5.5%±0.5% coating solids based on the weight of the grain, remained on the grains.

The coating was performed with grains prepared with 0.2, 1.4 and 5.0% moisture contents. At 5% moisture, the few seconds of immersion caused the gas generating grains to become soft. At 0.2% moisture, there was a tendency for the gas generating grains to shed coating. The surface wetting at about 1.4% grain moisture was satisfactory.

The coatings of the present invention adhered well to the gas generating grains, and ignition of the gas generating grains by the coatings was robust and insensitive to minor variation. The quantity of coating can range plus or minus 10% with little discernable effect on ignition across a full temperature range to which the coatings were exposed.

From the above description of a preferred embodiment of the invention those skilled in the art will perceive improvements, changes and modifications. Such improvements, changes and modifications to those skilled in the art are intended to be covered by the pending claims.

Having described a specific preferred embodiment of the invention, I claim:

1. A gas generating grain having a particulate booster coating thereon, said coating comprising an alkali metal azide, a water-soluble inorganic oxidizer in approximately a stoichiometric proportion of oxidizer to azide, and a water-insoluble metal oxide, said coating being applied to said grain as a water slurry and dried.

2. The grain of claim 1 wherein said coating when dried has an average particle size of about 50 microns or less.

3. The grain of claim 2 wherein said metal oxide is present in a nucleating amount.

4. The grain of claim 3 wherein said metal oxide has an average particle size less than about 0.5 micron.

5. The grain of claim 4 wherein said metal oxide is selected from the group consisting of iron oxide, nickel oxide, and aluminum oxide.

6. The grain of claim 4 wherein said metal oxide is iron oxide having an average particle size of about 0.2 micron.

7. The grain of claim 1 comprising about 5–6% by weight coating, based on the weight of the grain.

8. The grain of claim 1 wherein said oxidizer is a nitrate.

9. The grain of claim 8 wherein said nitrate is an alkali metal nitrate and the coating is applied to said grain from a water-based slurry, the proportion of nitrate to alkali metal azide in said slurry being about 107% of the stoichiometric proportion of nitrate to azide.

10. The grain of claim 1 wherein said coating comprises about 3–6% metal fuel.

11. The grain of claim 10 wherein said metal fuel is selected from the group consisting of boron, titanium, zirconium and silicon.

12. The grain of claim 10 wherein said metal fuel is boron.

13. The grain of claim 1 comprising boron and a nucleating amount of a water-insoluble metal oxide having an average particle size less than about 0.5 micron.

14. The grain of claim 13 wherein said boron is a pyrotechnic grade boron.

15. The grain of claim 13 wherein said metal oxide is iron oxide having an average particle size of about 0.2 micron.

16. The grain of claim 1 wherein said coating comprises on a weight basis;

about 34–37% inorganic oxidizer;
about 54–58% alkali metal azide;
about 3–6% boron;
about 1–3% iron oxide.

17. The grain of claim 16 wherein said alkali metal azide is sodium azide and said inorganic oxidizer is sodium nitrate.

18. The grain of claim 16 having a grain composition comprising sodium azide, sodium nitrate, iron oxide and bentonite.

19. The grain of claim 18 having a moisture content of about 1.4% prior to coating.

20. The grain of claim 16 wherein said slurry comprises a 60/40 solids/water mixture.

21. The grain of claim 16 oven dried following coating at a temperature of at least about 260° F.

22. The grain of claim 1 coated from a water slurry comprising:

| Ingredient | Weight Percentage |
|---|---|
| Sodium Nitrate | 36.59 ± 1.0% |
| Sodium Azide | 56.82 ± 1.5% |
| Boron | 4.51 ± 0.1% |
| Iron Oxide | 2.08 ± 0.1% |

23. A gas generating grain having a particulate booster coating thereon, said coating comprising an alkali metal azide, a water-soluble inorganic oxidizer in approximately a stoichiometric proportion of oxidizer to azide, and a nucleating amount of a water-insoluble metal oxide, said coating being applied to said grain as a water slurry and dried and when dried having an average particle size of about 50 microns or less.

24. A method for making a gas generating grain having a booster coating thereon, comprising the steps of:

(a) preparing said grain;

(b) preparing a coating slurry comprising water, an alkali metal azide, a water soluble inorganic oxidizer, and a water-insoluble metal oxide;

(c) immersing said grain in said coating slurry;

(d) removing said grain from said coating slurry and drying said grain and the coating thereon.

25. The method of claim 24 wherein said grain and coating thereon are rapidly dried.

26. The method of claim 25 wherein said grain and coating thereon are dried at a temperature in excess of 260° F.

27. The method of claim 24 wherein said metal oxide is a small particle size oxide present in a nucleating amount.

28. The method of claim 27 wherein said metal oxide is iron oxide having a particle size of about 0.2 micron.

29. The method of claim 24 wherein the ratio of inorganic oxidizer to azide is in excess of a stoichiometric proportion of oxidizer to azide.

30. The method of claim 29 wherein said inorganic oxide is sodium nitrate and said ratio is about 107% of the stoichiometric proportion of oxidizer to azide.

31. The method of claim 24 wherein said slurry contains a metal fuel.

32. The method of claim 24 wherein said grain has a moisture content prior to coating of about 1.4%.

33. The method of claim 24 wherein the weight ratio of solids to water is about 60/40.

34. The method of claim 24 wherein said slurry is comminuted prior to coating to reduce the particle size of the azide.

35. The method of claim 34 wherein said azide has an average particle size prior to coating less than about 20 microns.

36. A coated grain made by the method of claim 24.

* * * * *